US007322841B1

(12) United States Patent
Chuang

(10) Patent No.: US 7,322,841 B1
(45) Date of Patent: Jan. 29, 2008

(54) PUSH-PULL MECHANISM FOR REMOVABLE ELECTRONIC DEVICE

(75) Inventor: Chih-Peng Chuang, Taipei (TW)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/708,275

(22) Filed: Feb. 19, 2007

(51) Int. Cl.
*H01R 13/62* (2006.01)

(52) U.S. Cl. ..... 439/160; 361/726

(58) Field of Classification Search ..... 439/157, 439/160, 463, 464; 361/726, 727, 729
See application file for complete search history.

(56) References Cited

U.S. PATENT DOCUMENTS 6,749,448 B2 * 6/2004 Bright et al. ..... 439/160
6,890,206 B2 * 5/2005 Distad et al. ..... 439/372
6,908,323 B2 * 6/2005 Ice ..... 439/160
6,991,481 B1 * 1/2006 Guan et al. ..... 439/160
7,108,523 B2 * 9/2006 Hartman ..... 439/157
7,249,958 B2 * 7/2007 Ishikawa et al. ..... 439/141

* cited by examiner

*Primary Examiner*—Thanh-Tam Le
(74) *Attorney, Agent, or Firm*—Peter F. Corless; Steven M. Jensen; Edwards Angell Palmer & Dodge LLP

(57) ABSTRACT

A push-pull mechanism is applicable to a removable electronic device having a latch hole. The removable electronic device is receivable in a receiving space of a mechanical housing having two protrusion portion corresponding to two sides of the receiving space. The push-pull mechanism includes a handle and a lock element. The handle has a level portion and two extension portions extending from two sides of the level portion. Two hook portions corresponding to the protrusion portions are installed on the extension portions. The lock element is slidingly installed on the level portion and has a latch hook corresponding to the latch hole, for coupling with the latch hole, so as to fix the handle to the removable electronic device.

9 Claims, 6 Drawing Sheets

PUSH-PULL MECHANISM FOR REMOVABLE ELECTRONIC DEVICE

BACKGROUND OF THE INVENTION

1. Field of the Invention

This invention generally relates to push-pull mechanisms, and more specifically, to a push-pull mechanism which is applicable to a removable electronic device.

2. Description of Related Art

Along with the technology advancement, the demands of users for operation power and storage capacity are getting higher and higher. A traditional large-scale server system has at least two or three, or as many as thousands of server units. Compared with a desktop computer, the server system has varieties of advantages, such as higher operation speed, longer and reliable operation hours, and more powerful external data inputting/outputting capability.

In order to ensure that the server system can process mass calculation, a plurality of electronic devices are installed in the server system. In order to be attached into and detached from the server system, these electronic devices are usually first installed in a removable mechanical housing, and then inserted the server system together with the removable mechanical housing.

A removable hard disk of the prior art, as shown in FIGS. 1A and 1B, which illustrates Taiwanese Patent No. 531027 titled by "Removable Hard Disk Module", provides in a computer system a mechanical case 11 provided with a receiving space 110 for receiving a frame 12. A blocker 112 is installed on a side of the receiving space 110. The frame 12 is for installing an electronic device (not shown). A first connection port 13 is installed in the receiving space 110 of the mechanical case 11 has, and a second connection port 14 corresponding to the first connection port 13 is installed in a rear end of the frame 12. A panel 15 is installed in a front side of the frame 12. A handle 16 is pivotally installed on the panel 15. The handle 16 has a check portion 161, and can be pushed together with the frame 12 into the receiving space 110 only when the handle 16 is pulled. The check portion 161, after the handle 16 is released, props against the blocker 112 of the mechanical case 11 and acts as a fulcrum, and a user can use the handle 16 as a lever to push the frame 12 into the receiving space 110, and have the second connection port 14 to be connected to the first connection port 13.

However, when use the handle 16 to push the frame 12 into the receiving space 110, the force is applied only to a single side of the frame, therefore, in order to fix an electronic device in the mechanical case 11 and connect the first connection port 13 with the second connection port 14, it takes more labor force to fix and push the frame 12 that has the electronic device installed inside into the receiving space 110 of the mechanical case 11; on the other hand, to pull out the frame 12, there is completely no supporting point, the user must use the handle 16 to directly pull out the frame 12, and meanwhile, must apply enough labor force to free the second connection port 14 from the first connection port 13. The process of pulling out the frame is not ideal and also consuming strength, thus it needs further improvement.

Please refer to FIGS. 2A and 2B, which illustrate Taiwanese Patent No. 509370 entitled by "Improvement of Removable Hard Disk Structure", wherein, a removable cartridge 22 is installed inside a receiving space of a frame hut 21, and the removable cartridge 22 can be inserted in and drawn from the frame hut 21, the removable cartridge 22 can have an electronic device installed inside, not shown in the figures; a slot 220 is located in the front face of the cartridge 22; and a movable buckle 23 is individually and pivotally connecting to each side of the slot 220, the pivoting end of each movable buckle 23 has an extension portion 231 that perpendicularly extends inward; a hollow frame body 24 is installed on the top of the slot 220, and inside the frame body 24, a pair of inlay buckles 25 are movably located on two opposite sides of the frame body 24; and an elastic element 26 is located between the pair of the inlay buckles 25 and tie to the inner end of each inlay buckle, therefore, the outer end of each inlay buckle 25 can protrude from the frame body 24 by means of the elasticity of the elastic element 26, and each inlay buckle 25 has a raised body 251 at a proper position atop, the frame body 24 has a slot hole 240 at the position corresponding to each of the raised body 251, the raised body 251 will protrude from the slot hole 240 and the slot hole 240 further restricts the movement of the raised body 251, consequently, the inlay buckle 25 will be secured inside the frame body 24, the frame hut 21 also has an inlay hole 210 at the position corresponding to each of the inlay buckle 25 to couple with the outer end of each inlay buckle 25; the two movable buckles 23 can be opened separately rightward and leftward to make each of the moveable buckle 23 prop against the raised body 251 of the inlay buckle 25, then consequently pushes the outer end of the inlay buckle 25 out of the inlay hole 210 of the frame hut 21, therefore, the removable cartridge can be removed from the frame hut 21.

However, the inlay buckle 25 can only secure the removable cartridge 22 at the frame hut 21, when pull out the removable cartridge, there is no mechanical supporting point, consequently, in the process of electricity connection between the removable cartridge 22 and the frame hut 21, the inserting and withdrawing can only be done by labor efforts, therefore, it is very inconvenient for pulling out the removable cartridge 22. Meanwhile, the removable cartridge 22 does not have a handle, thereby lacking a supporting point for pulling out the removable cartridge 22 from the frame hut 21, it is not convenient for operation.

Hence, it is a highly urgent issue in the industry for how to provide a technique which can effectively solve the aforementioned drawbacks of either the single applied force or the secure mechanism without a handle of the removable hard disk of the prior art.

SUMMARY OF THE INVENTION

In views of the aforementioned disadvantages of the prior art, it is a primary objective of the present invention to provide a push-pull mechanism for a removable electronic device, the push-pull mechanism capable of saving labor for pulling out the removable electronic device.

It is another objective of the present invention to provide a push-pull mechanism for a removable electronic device, the push-pull mechanism capable of locking up a handle installed in the removable electronic device to prevent the electronic device and its database from being damaged by accident.

To achieve the aforementioned and other objectives, a push-pull mechanism for a removable electronic device is provided according to the present invention. The push-pull mechanism is applicable to the removable electronic device, which has a front side, two sides, and at least one latch hole installed on the front side of the removable electronic device and is receivable in a receiving space of a mechanical housing having two protrusion portion corresponding to two sides of the receiving space. The push-pull mechanism includes a handle and a lock element. The handle has a level portion and two extension portions extending from two sides of the level portion pivotally connected to the two sides of the removable electronic device near the front side. The extension portions have two hook portions corresponding to the protrusion portions of the mechanical housing. By pushing and turning the handle, the hook portions prop against the protrusion portions respectively, so as to fix the removable electronic device into the mechanical housing. The lock element is slidingly installed on the level portion of the handle and has at lease one latch hook corresponding to the at least one latch hole. By coupling the latch hook with the latch hole, the handle is fixed to the front side of the removable electronic device.

To steadily pull out the removable electronic device from the mechanical housing, first push and move the handle to free the hook portion from the mechanical housing, next turn the handle outward to make each of the extension portion individually prop against each front side of the mechanical housing, at last, to avoid single side applied force, evenly apply force on both sides of the handle to pull out the removable electronic device steadily.

The lock element is flat. A plurality of lead apertures and first fix elements such as bolts are installed on the lock element, for fixing the lock element to the level portion of the handle by going through the plurality of lead apertures, thereby giving the lock element the capability of spacing translation, and the lock element is installed on the inner or outer side of the holding area of the handle, an elastic element, which is a spring, is installed between the lock element and each extension portion of the handle, by means of the elastic push force of the elastic element, the latch hook of the lock element can couple with the latch hole of the removable electronic device, and consequently fix the lock element to prevent the electronic device and its database from being damaged by accident.

The push-pull mechanism further comprises a cover element, which is located on the surface of the lock element, the cover element is integrated with the lock element through a plurality of screws that serve as a plurality of second fix elements, therefore, the cover element is fixed to the lock element, the cover element provide with the convenience for pushing and moving the lock element to free the hook portion of the handle from the protrusion portion of the mechanical housing, thus allow to turn the handle outward and pull out the removable electronic device from the mechanical housing.

In view of the above, the removable electronic device push-pull mechanism according to the present invention which allows applying force on both sides of the handle to pull out the removable electronic device, therefore, it saves labor efforts and overcomes the aforementioned drawbacks of either the single applied force or the secure mechanism without a handle for saving labor efforts according to the removable hard disk of the prior art, and furthermore, the present invention provides a lock structure that is capable of preventing the electronic device and its database from being damaged by accident.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 1A:
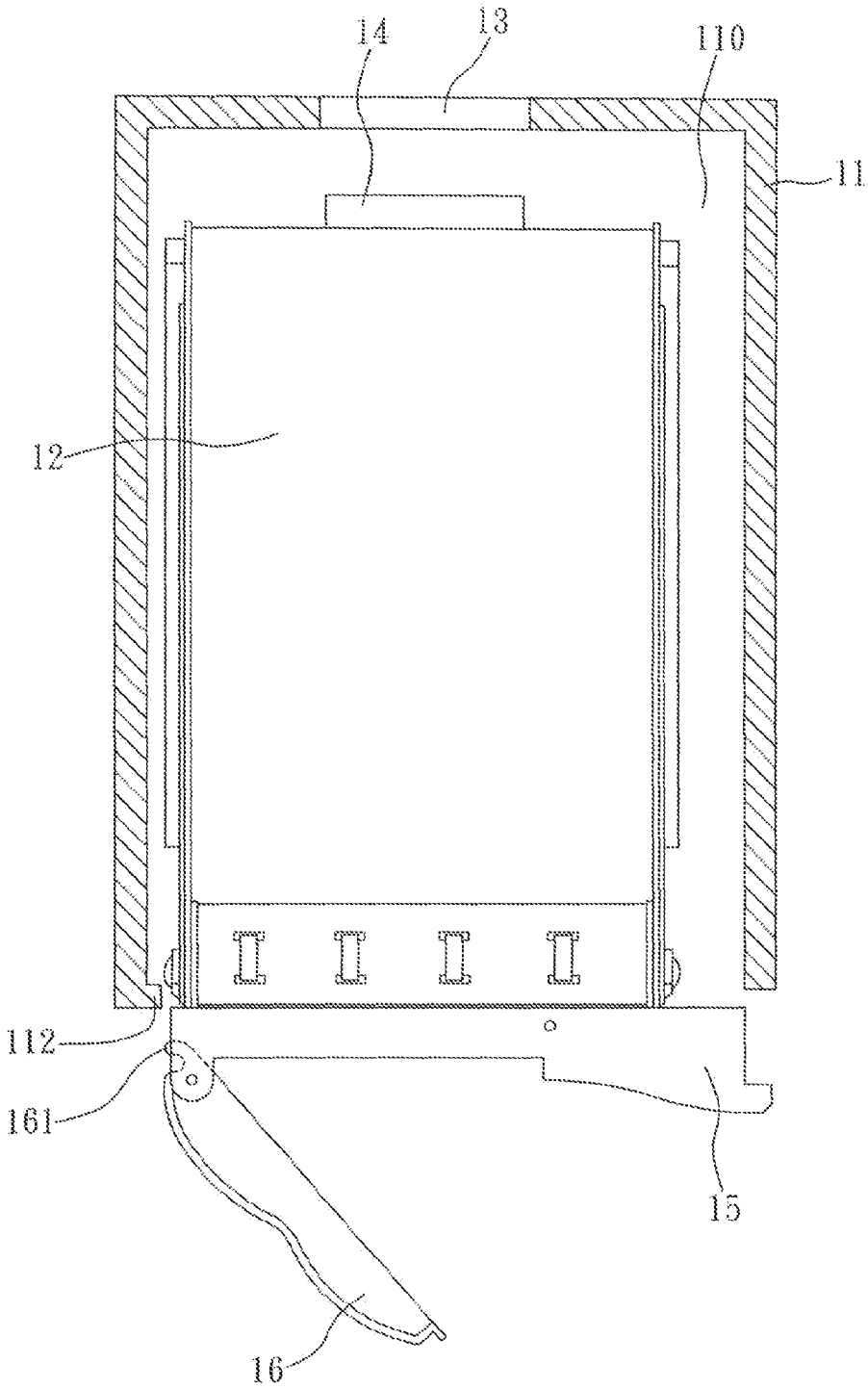
FIG. 1A PRIOR ART
FIGS. 1A and 1B are structure diagrams of Taiwanese Patent No. 531027, which illustrate the states of a handle being lifted outward and shut.
Figure 1B:
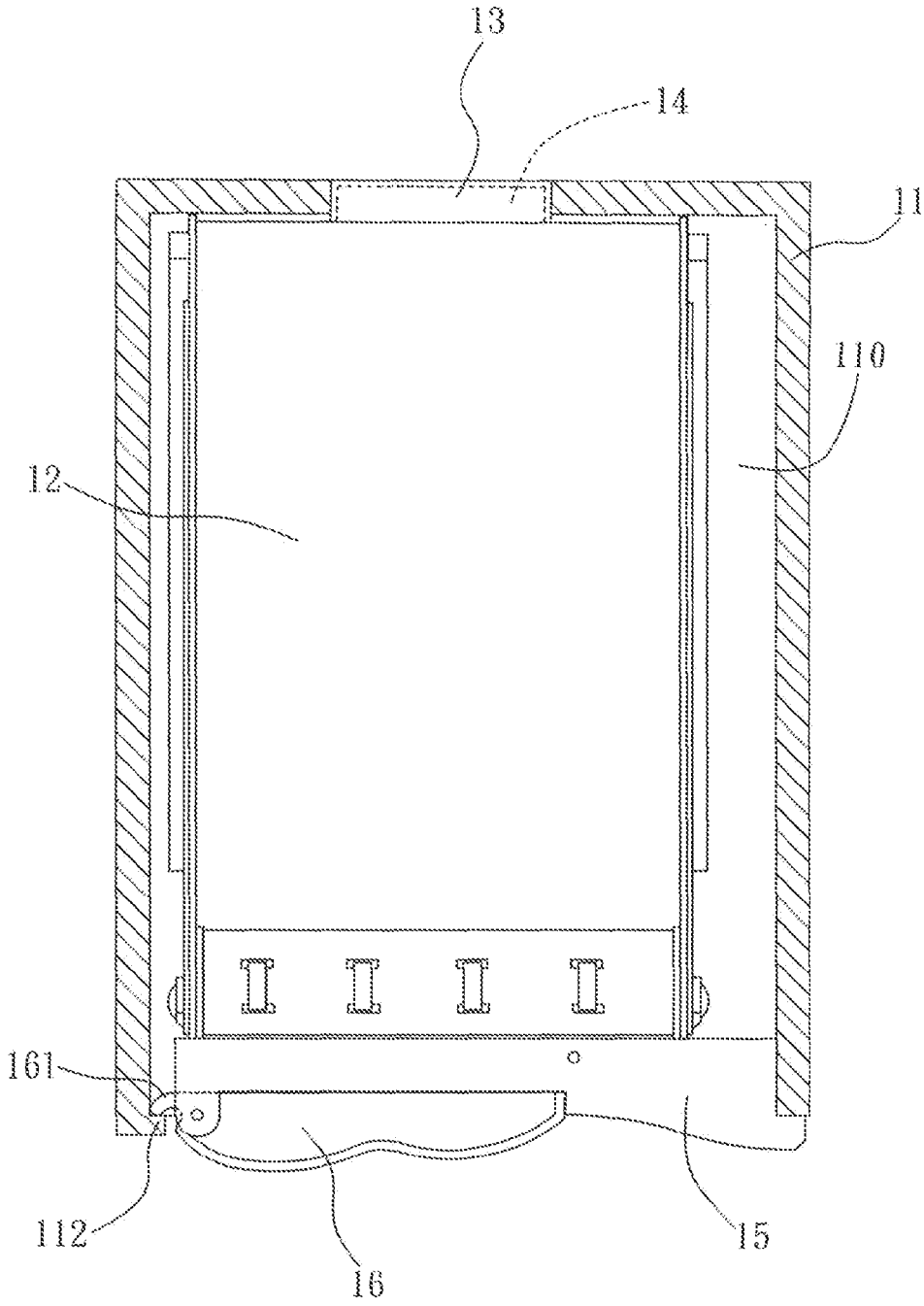
FIG. 1B PRIOR ART
Figure 2A:
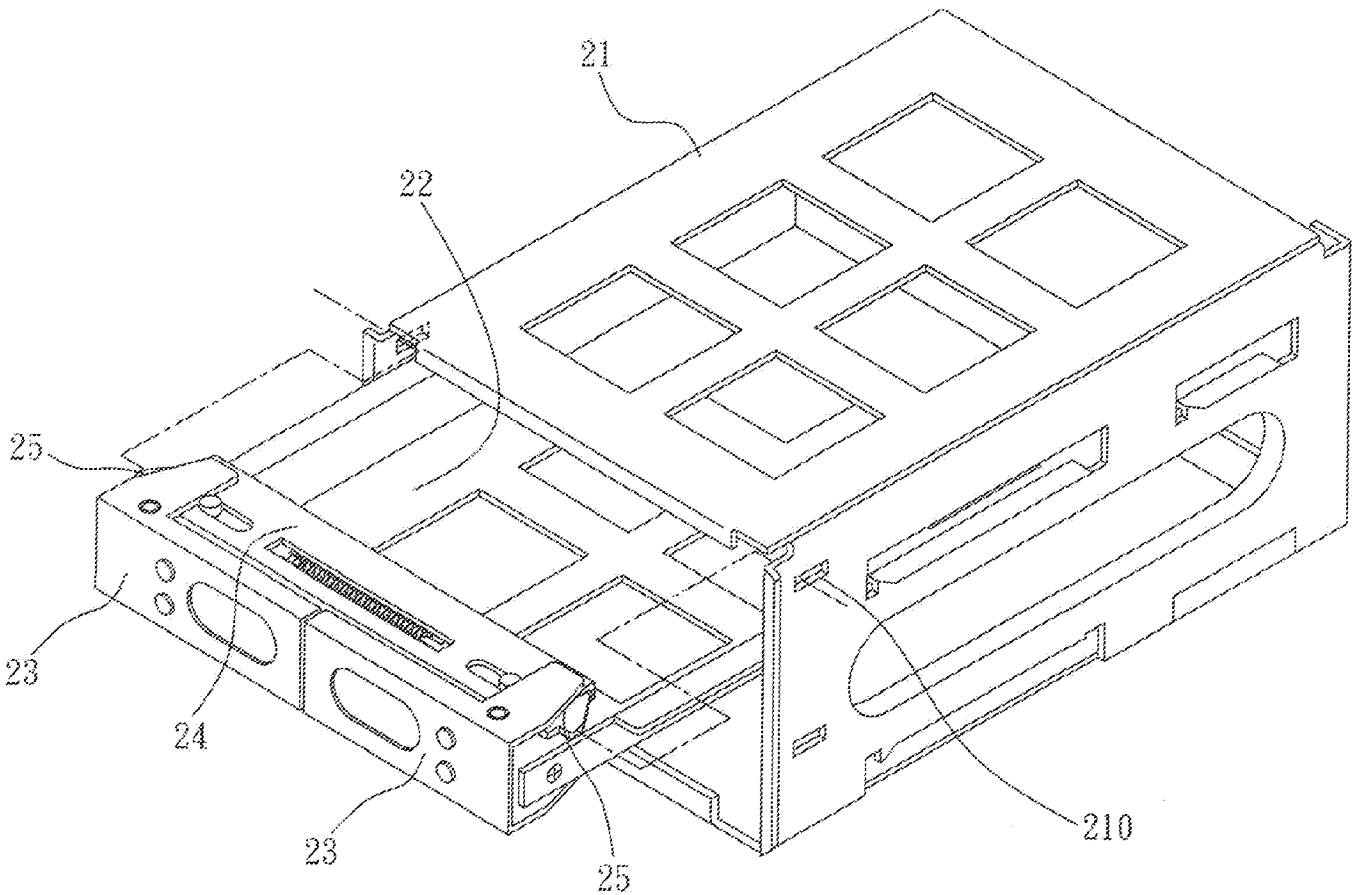
FIG. 2A PRIOR ART
FIGS. 2A and 2B are a pictorial drawing and a pictorial breakdown illustration of Taiwanese Paten No. 509370.
Figure 2B:
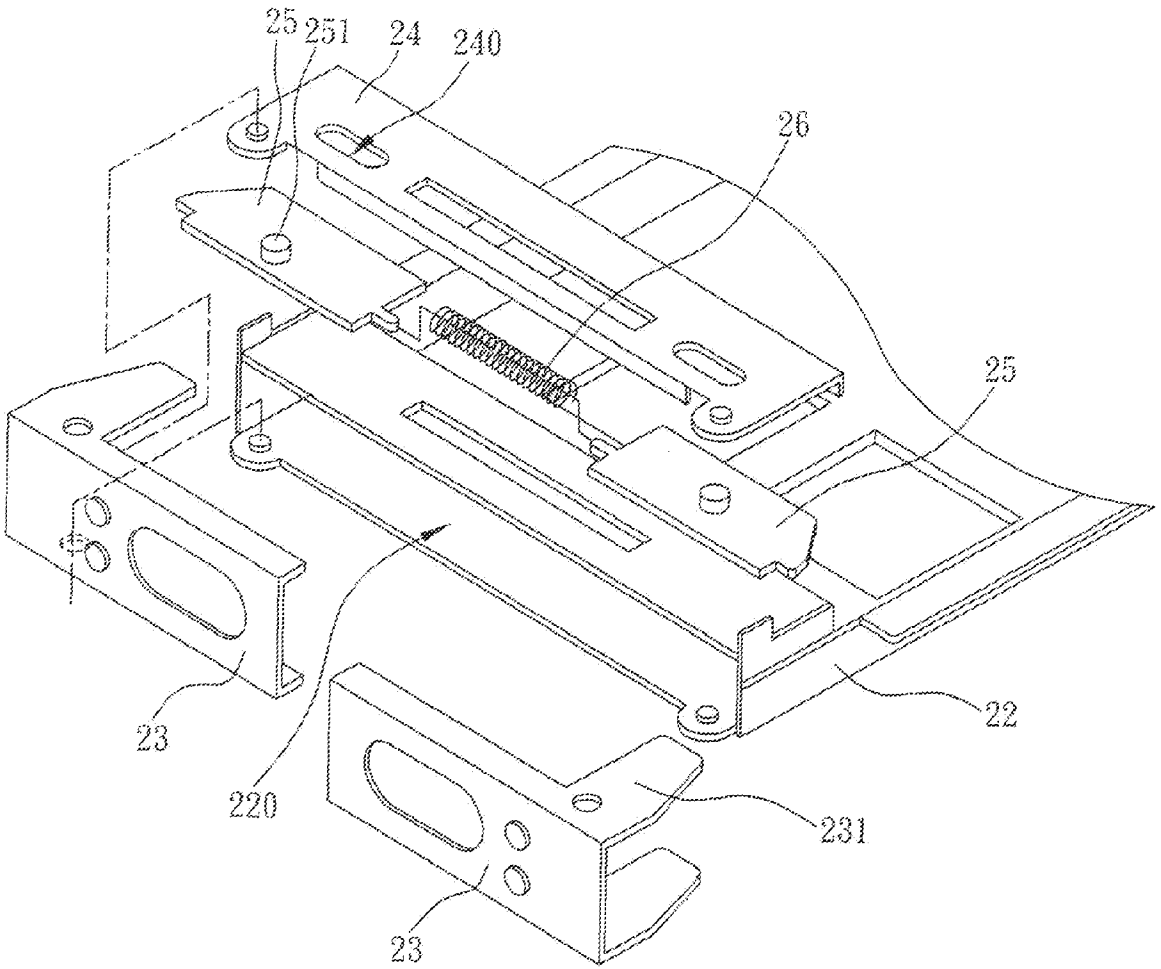
FIG. 2B PRIOR ART
Figure 3A:
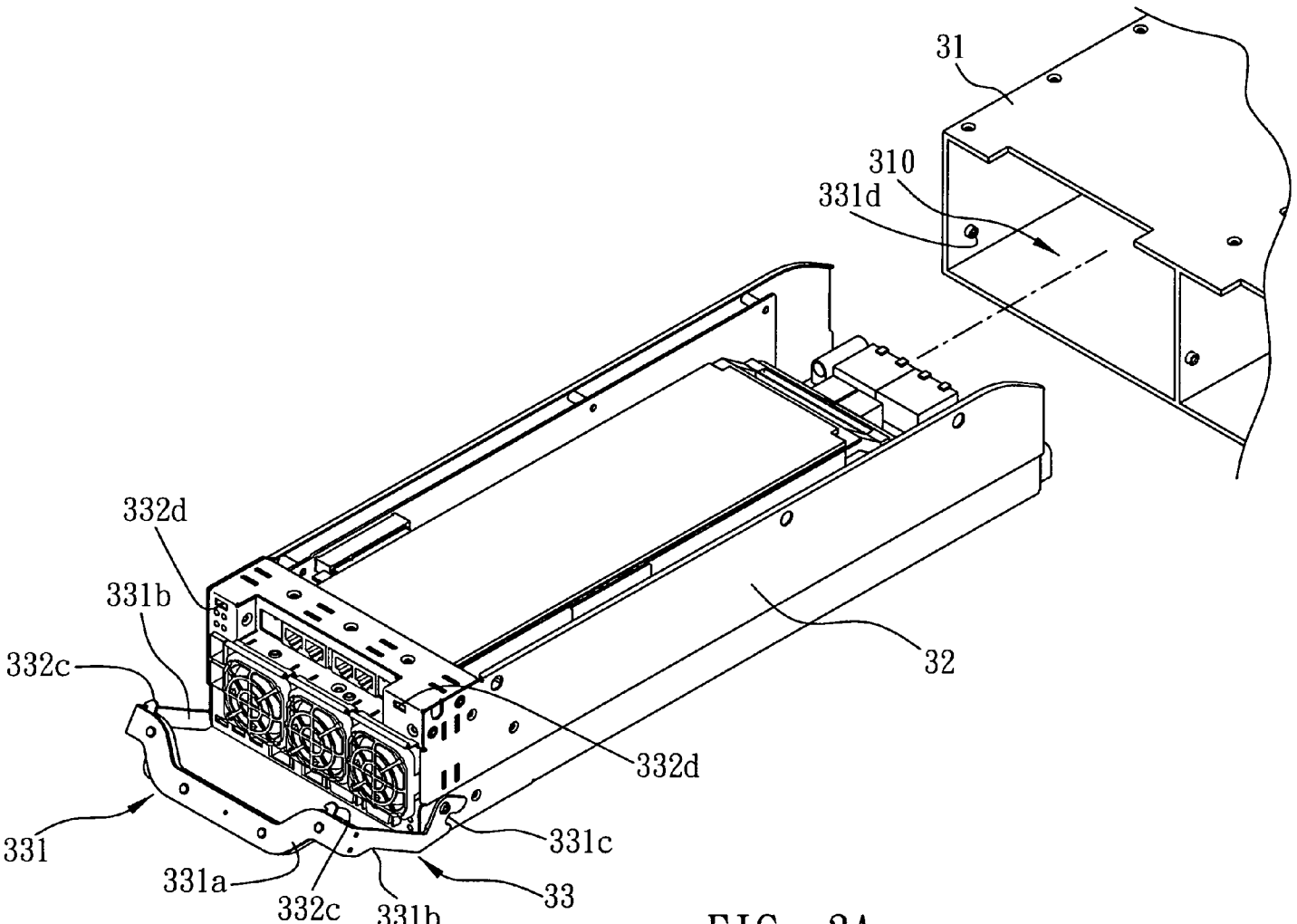
FIG. 3A is a pictorial drawing of a removable electronic device push-pull mechanism according to the present invention, which illustrates a mechanical housing and a removable electronic device.
Figure 3B:
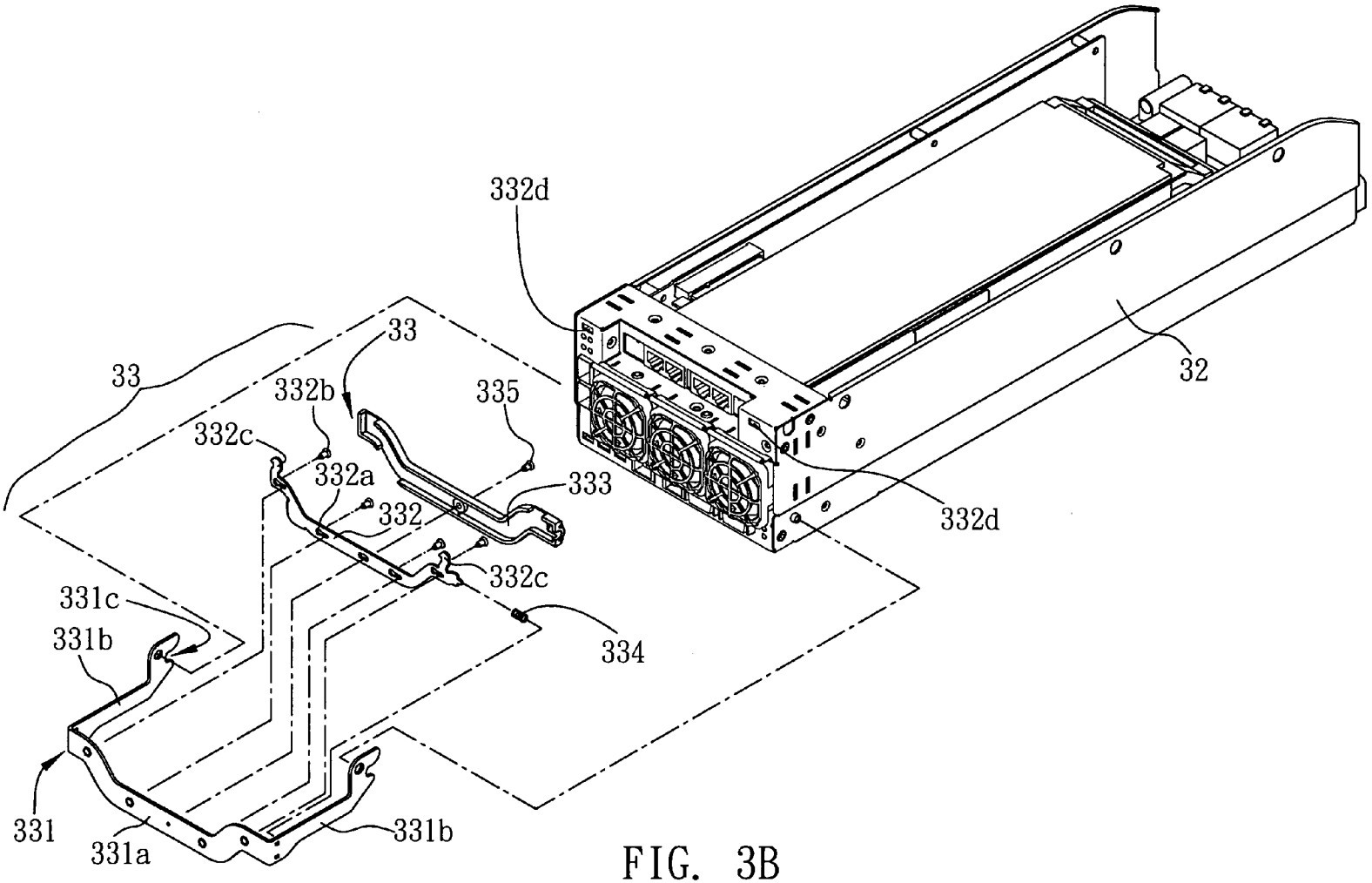
FIG. 3B is a pictorial breakdown illustration of a removable electronic device push-pull mechanism according to the present invention.

Please refer to FIGS. 3A and 3B, which are schematic diagrams of a push-pull mechanism 33 for a removable electronic device of the preferred embodiment according to the present invention.

As shown in FIG. 3A, a mechanical housing 31 has a receiving space 310, a removable electronic device 32 is received in the receiving space 310, and the push-pull mechanism 33 is installed in front of the removable electronic device 32. The push-pull mechanism 33 is used to push and pull the removable electronic device 32.

As shown in FIG. 3B, the push-pull mechanism 33 comprises a handle 331, a lock element 332, and a cover element 333.

The handle 331 has a level portion 331*a* and two extension portions 331*b* installed on two sides of the level portion 331*a*, and is therefore in the shape of an open rectangle. Ends of the extension portions 331*b* are pivotally installed on two sides of the removable electronic device 32 near a front side thereof, and the extension portions 331*b* are pivotally located on both sides of the removable electronic device 32. Each of the extension portions 331*b* of the handle 331 further has a hook portion 331*c*, and two protrusion portions 331*d* corresponding to the hook portions 331*c* are installed in the receiving space 310 of the mechanical housing 31. Therefore, the handle 331 can be pushed and turned upward and downward to prop the hook portions 331*c* against the protrusion portions 331*d*. Next, push and turn the handle 331 toward a surface of the removable electronic device 32, thus the handle 331 takes the protrusion portions 331*d* as supporting points and pushes the removable electronic device 32 into the receiving space 310 of the mechanical housing 31. On the other hand, to pull out the removable electronic device 32, first push and turn the handle 331 outward, the handle 331 also takes the protrusion portions 331*d* as the supporting points and pulls out the removable electronic device 32. Therefore, the handle 331 takes the extension portions 331*b* on both sides as the force arm, and force is applied on both protrusion portions 331*d* of the receiving space 310 of the mechanical housing 31, thus it saves labor force to pull out or insert the removable electronic device 32 from/in the receiving space 310, therefore overcomes the drawbacks of the single side applied force or the lack of a labor-saving mechanism of the prior art.

The lock element 332 is slidingly installed on an outer side or an inner side of the level portion 331*a* of the handle 331. According to the preferred embodiment, the lock element 332 is installed on the inner side. However, the operation and performance are the same even if the lock element is installed on the outer side. The lock element 332 is flat. A plurality of lead apertures 332*a* are installed on the flat lock element 332. The lock element 332 is fixed to the level portion 331*a* of the handle 331 by a plurality of first fix elements 332*b* such as a plurality of bolts by passing lead apertures 332*a*, and is allowed to move perpendicularly to the plurality of first fix elements 332*b*. At least a latch hook 332*c* is installed on a side of the lock element 332. Accordingly, a latch hole 332*d* corresponding to the latch hook 332*c* is installed on a front side of the removable electronic device 32 has on each front side. An elastic element 334 such as a spring is installed between the extension portion 331*b* of the handle 331 and the lock element 332. One end of the elastic element 334 is mounted on one end of the lock element 332, and the other end of the elastic element 334 props against the extension portion 331*b* of the handle 331. Therefore, the elastic element 334 can push the lock element 332 to move.

The cover element 333 is engaged with the lock element 332 by means of a plurality of second fix elements 335. As a result, the cover element 333 acts as a push portion. Since the cover element 333 is engaged with the lock element 332, by pushing the cover element 333, the lock element 332 is moved, thus the latch hook 332*c* of the lock element 332 is tilted and detached from the latch hole 332*d*. Consequently, the handle 331 can be turned outward and uncouple the latch hook 332*c* from the latch hole 332*d*, and the removable electronic device 32 can be pulled out. On the other hand, after the removable electronic device 32 is pushed into the receiving space 310 and the handle 331 is pushed toward and leaned on the front side of the removable electronic device 32, the latch hook 332*c* will lean against the latch hole 332*d*, and, by pushing the lock element 332 to move with the elastic element 334, the latch hook 332*c* can be coupled with the latch hole 332*d*, so as to fix the handle 331 and fix the removable electronic device 32 in the receiving space 310. Moreover, the lock mechanism is integrated into the handle 331, therefore, the structure is simplified and easy to be operated.

In view of the aforementioned description, the removable electronic device push-pull mechanism according to the present invention, which has the hook portions of extension portions of both sides prop against the protrusion portions in the receiving space of the mechanical housing, and by making use of the protrusion portions as supporting points to apply force on both sides of the handle to pull out or push in the removable electronic device, it is labor saving for pulling out the removable electronic device and also avoids the drawbacks of applying force on single side of the handle; and the inner side or outer side of holding area of the handle has a lock element that is capable of sliding, the lock element has at least a latch hook that can couple with the at least one latch hole of the removable electronic device, therefore, the handle has the function of a lock and it can also secure the removable electronic device in the receiving space, that the structure of the lock element is integrated with the handle also simplifies the mechanism and gives the benefit of simplifying the operation and convenience of use.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A push-pull mechanism for a removable electronic device having a front side, two sides, and at least one latch hole installed in the front side of the removable electronic device, the removable electronic device being receivable in a receiving space of a mechanical housing having two protrusion portions corresponding to two sides of the receiving space, the push-pull mechanism comprising:

a handle having a level portion and two extension portions extending from two sides of the level portion pivotally connected to the two sides of the removable electronic device near the front side, the extension portions having two hook portions corresponding to the protrusion portions of the mechanical housing, by pushing and turning the handle, the hook portions propping against the protrusion portions respectively, so as to fix the removable electronic device into the mechanical housing; and a lock element slidingly installed on the level portion of the handle and having at least one latch hook corresponding to the at least one latch hole, by coupling the latch hook with the latch hole, the handle being fixed to the front side of the removable electronic device.

2. The push-pull mechanism of claim 1, wherein the lock element is installed on either an inner side or an outer side of the level portion of the handle.

3. The push-pull mechanism of claim 1 further comprising a plurality of first fix elements, wherein the lock element is flat, and a plurality of lead apertures are installed on the lock element for allowing the first fix elements to pass, so as to fix the lock element to the level portion of the handle and allow the lock element to move perpendicularly to the plurality of first fix elements.

4. The push-pull mechanism of claim 3, wherein at least one of the first fix elements is a bolt.

5. The push-pull mechanism of claim 3 further comprising an elastic element installed between the lock element and one of the extension portions of the handle, for pushing the lock element.

6. The push-pull mechanism of claim 5, wherein the elastic element is a spring.

7. The push-pull mechanism of claim 1 further comprising a cover element installed on the lock element.

8. The push-pull mechanism of claim 7 further comprising a plurality of second fix elements for engaging the cover element with the lock element.

9. The push-pull mechanism of claim 8, wherein at least one of the second fix elements is a screw.

* * * * *